US006543259B1

(12) United States Patent
Sherratt et al.

(10) Patent No.: US 6,543,259 B1
(45) Date of Patent: Apr. 8, 2003

(54) DOSING DEVICE

(75) Inventors: Paul Robertson Sherratt, Leeds (GB); Mark Shickle, London (GB)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/505,330

(22) Filed: Feb. 16, 2000

(30) Foreign Application Priority Data

Feb. 18, 1999 (GB) ..... 9903752

(51) Int. Cl.[7] ..... D06F 39/02

(52) U.S. Cl. ..... 68/12.12; 68/12.18; 68/17 R; 68/207; 8/158

(58) Field of Search ..... 68/12.12, 12.18, 68/17 R, 17 A, 207

(56) References Cited

U.S. PATENT DOCUMENTS

| | | | | |
|---|---|---|---|---|
| 2,792,701 | A | * | 5/1957 | Bochan |
| 2,872,076 | A | * | 2/1959 | Bloom |
| 2,912,842 | A | * | 11/1959 | Tingley, Jr. |
| 2,949,025 | A | * | 8/1960 | Tingley, Jr. |
| 2,955,450 | A | * | 11/1960 | Tingley, Jr. |
| 2,973,636 | A | * | 3/1961 | Devery et al. |
| 3,048,993 | A | * | 8/1962 | Lucas et al. |
| 3,079,783 | A | * | 3/1963 | Stanger |
| 3,225,574 | A | * | 12/1965 | Ziegler |
| 3,248,914 | A | * | 5/1966 | Tingley, Jr. |
| 3,268,120 | A | * | 8/1966 | Durst |
| 3,481,163 | A | * | 12/1969 | Bochan et al. |
| 3,736,773 | A | * | 6/1973 | Waugh |
| 4,186,573 | A | | 2/1980 | Brenner et al. |
| 4,186,574 | A | * | 2/1980 | Sundstrom |
| 5,033,277 | A | | 7/1991 | Khan |

FOREIGN PATENT DOCUMENTS

| | | | |
|---|---|---|---|
| GB | 2 263 484 | | 7/1993 |
| GB | 2 317 378 | | 3/1998 |
| JP | 59-149188 | * | 8/1984 |
| JP | 59-149189 | * | 8/1984 |
| JP | 62-16666 | * | 4/1987 |
| JP | 4-33693 | * | 2/1992 |
| JP | 2056969 | * | 6/1992 |
| JP | 4-285594 | * | 10/1992 |
| WO | 95/04682 | | 2/1995 |

* cited by examiner

*Primary Examiner*—Frankie L. Stinson
(74) *Attorney, Agent, or Firm*—Gerard J. McGowan, Jr.

(57) ABSTRACT

A device for dosing rinse conditioner to a drum of a washing machine comprises three chambers connected in series to an interior of a drum of a washing machine. The first chamber receives the composition prior to a start of the wash cycle and includes an outlet through which the composition is transferred to a holding chamber under centrifugal forces generated during a first spin cycle. During a second spin cycle the treatment composition is similarly transferred from the holding chamber to a dispensing chamber from which the composition is delivered onto the fabrics upon completion of the second spin cycle. A washing process employing the device of the invention is also disclosed.

15 Claims, 1 Drawing Sheet

DOSING DEVICE

INTRODUCTION

Figure 1:
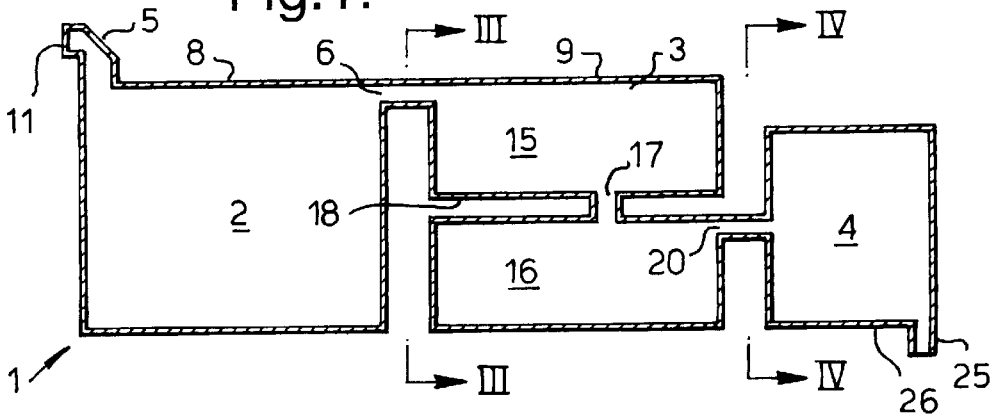

The invention relates to a dosing device for fabric washing machines. In particular, the invention relates to a device for dosing fabric treatment composition, and particularly rinse conditioner compositions, into a drum of a top loading washing machine in between a second and third spin cycle of the machine.

Automatic fabric washing machines generally include a number of distinct stages involving a first washing stage where the clothes are agitated with wash liquor and detergent followed by a rinse stage where the clothes are rinsed. Generally, the rinse stage comprises three separate spin cycles, a first spin to remove detergent liquor, a second spin to remove the rinse liquor added to the drum between the first and second spins, and a third spin to remove the final rinse liquor added to the drum between the second and third spins. To achieve an effective treatment of the fabrics it is advantageous to add rinse conditioner compositions to the final rinse liquor between the second and third spin cycles. heretofore this has been effected by manually adding the rinse conditioner to the drawer of the machine between the second and third spins. However, as this involves visually observing the wash until completions of the second spin cycle it is clearly an inconvenience for the user.

In an attempt to overcome the problem with manual dosing of rinse conditioners, certain machine manufacturer developed a device for automatic dosing of rinse conditioner which comprises a pair of chambers connected in parallel and integrally mounted to the drum of the machine during manufacture of the machine. In more detail, the first chamber which is exposed in an interior of the drum includes filling opening and an outlet leading to the second chamber such that during a first spin the rinse conditioner is transferred to the second chamber which lies between inner and outer drums of the machine. The second chamber includes an outlet such that during a second spin cycle the rinse conditioner is sprayed in small droplets onto the outer drum of the machine. A number of problems are associated with this device. First, as the device includes a pair of chambers mounted on opposite sides of the wall of the inner drum, the device cannot be installed in existing machines without structurally altering the drum of the machine. This is clearly inadvisable, not least for the reason that the alteration of the drum would adversely affect the delicate balancing of the drum.

Second, as the second chamber is mounted before the inner and outer drums of the machinery this result in delivering of the product onto the outer drum of the machine. In order for the product to contact the wash water it must have time to run down the side walls of the drum to the sump, however, due to the viscosity of such compositions, this can take some time resulting in an incomplete dosing of the product to the rinse water. This problem is exacerbated by the fact that due to the construction of the device the product is delivered during the second spin cycle resulting in a fine spray of small droplets onto the drum of the machine. Furthermore, the dosing of the product onto the inner drum of the machine has been found to result in a shearing effect on rotors of the drum.

It is one object of the present invention to overcome at least some of the above problems.

STATEMENTS OF INVENTION

According to the invention there is provided a device for dosing fabric treatment composition to a drum of a top loading automatic washing machine of the type comprising a washing stage and at least two spin cycles, the device comprising at least three interconnected chambers mounted to a drum of the washing machine, namely:

- a reservoir chamber having filling opening means and an outlet;
- a holding chamber communicating with the reservoir chamber outlet for receiving said composition from said reservoir chamber during a first of said spin cycles; and
- a dispensing chamber communicating with a holding chamber outlet for receiving said composition from said holding chamber during a second of said spin cycles, the dispensing chamber further including an outlet for dispensing said composition upon substantial completion of said second spin cycle.

Preferably, the holding chamber comprises an upper region which receives and holds treatment composition from the reservoir chamber during the first spin cycle, a lower region which delivers treatment composition to the dispensing chamber during the second spin cycle, and an intermediate region connecting the upper and lower regions such that between the first and second spin cycles the treatment composition is transferred under the force of gravity from the upper to the lower region.

Ideally, the intermediate region forms a barrier to prevent the treatment composition passing back from the lower region to the upper region during the second spin cycle.

Ideally, the upper and lower regions comprise distinct upper and lower compartments and wherein the intermediate region comprises a conduit connecting the compartments.

In a preferable embodiment of the invention the conduit is arranged on a base of the upper compartment, wherein the base is preferably shaped to funnel treatment composition into the conduit. Typically, the holding chamber has a rear wall facing a wall of the drum of the machine, and a front face, and wherein the conduit is spaced from the rear wall. Typically, a base of the upper compartment is shaped to funnel composition towards the outlet, by means of for example, the base being slanted. Ideally, a top of the lower compartment is shaped to direct the composition towards the holding chamber outlet under centrifugal force.

In one embodiment of the invention the at least three chambers are connected in series.

Preferably the device includes means for the mounting thereof to an interior of the drum of the machine. Ideally the mounting means allow retrofitting of the device.

In a particularly preferable embodiment of the invention the reservoir chamber has a rear portion adjacent the drum of the machine, an opposed front portion, and a top portion, wherein the reservoir chamber outlet means is disposed adjacent the rear and top portions of the chamber.

Preferably, the rear and top portions are shaped to funnel or otherwise bias the transfer of the composition into the reservoir chamber outlet under the centrifugal forces generated during the first spin cycle. Thus, the top and base may be slanted or curved towards the outlet.

In one embodiment of the invention the holding chamber outlet means is disposed adjacent an upper rear portion of the lower region of the holding chamber.

Preferably, the dispensing outlet is disposed towards a lower portion of the dispensing chamber. Ideally the filling chamber inlet is disposed adjacent a top of the filling chamber, and preferably spaced from the rear of the chamber away from the drum of the machine. Typically, the filling chamber includes a closure for the filling chamber inlet.

The invention also relates to a laundry washing machine comprising a device according to the invention. The combination of a device according to the invention and a fabric treatment composition, such as for example a liquid rinse conditioner, is also envisaged.

The invention also relates to a use of a device according to the invention for delivering liquid rinse conditioner to an interior of a drum of a washing machine during a rinse cycle.

The invention also relates to a process for delivering fabric treatment composition to an interior of a drum of a washing machine during a rinse cycle of the machine by employing a device according to the invention, the process comprising the steps of:

adding fabric treatment composition to the reservoir chamber prior to a start of wash cycle;

carrying out a wash stage;

carrying out the first spin cycle whereupon the fabric treatment composition is transferred under centrifugal forces from the reservoir chamber to the holding chamber;

carrying out the second spin cycle whereupon the treatment composition is transferred under centrifugal forces from the holding chamber to the dispensing chamber;

delivering the treatment composition from the dispensing chamber to the interior of the drum under force of gravity prior to and/or during addition of final rinse solution;

carrying out a final rinse cycle by agitating the fabrics, rinse solution and treatment composition for an effective period of time; and carrying out a final spin.

DETAILED DESCRIPTION OF THE INVENTION

Figure 2:
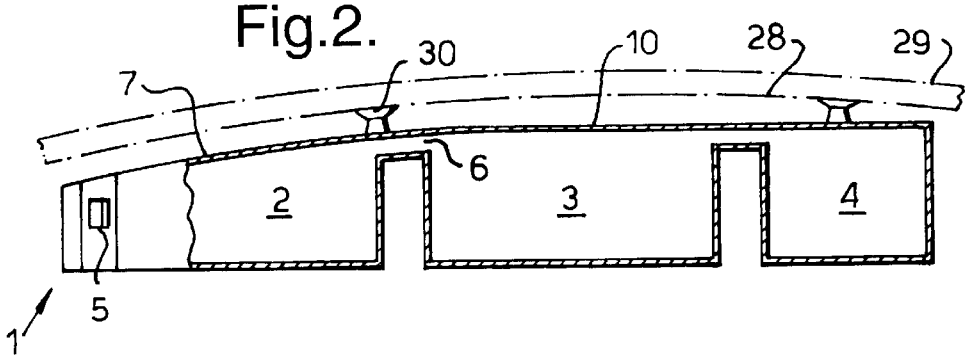
Figure 3:
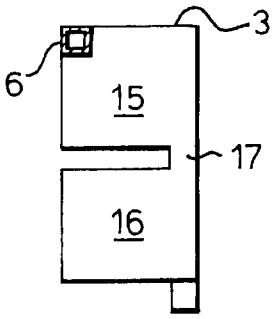
Figure 4:
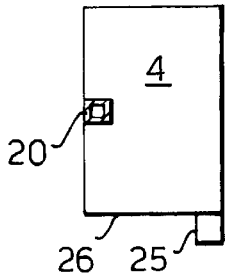
Figure 5:
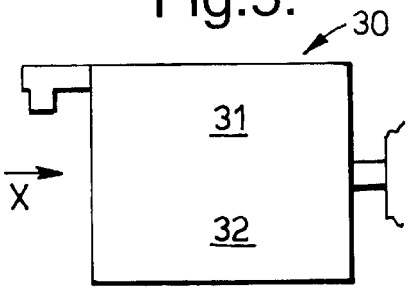
Figure 6:
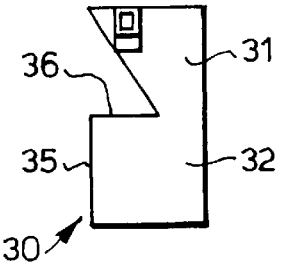

The invention will be more clearly understood from the following description of some embodiments thereof, given by way of example only, with reference to the accompanying drawing in which:

FIG. 1 is a front elevational view of a device according to the invention,

FIG. 2 is top view of the device of FIG. 1 attached to an inner drum of a washing machine, FIG. 3 is sectional view of the device along the line III—III of FIG. 1, FIG. 4 is sectional view of the device along the line IV—IV of FIG. 1, FIG. 5 is a front elevational view of a holding chamber according to an alternative embodiment of the invention; and FIG. 6 is a side elevational view of the holding chamber of FIG. 5 looking in the direction of the arrow marked X.

Referring to the drawings, and initially to FIGS. 1 to 4, there is illustrated a dosing device according to the invention, indicated generally by the reference numeral 1, and comprising three chambers connected in series, namely a reservoir chamber 2, a holding chamber 3 and a dispensing chamber 4. In more detail, the reservoir chamber 2 includes a reservoir opening 5, associated closure 11, and a reservoir chamber outlet 6 disposed towards a rear face 7, and adjacent a top 8, of the chamber 2, which outlet 6 communicates with the holding chamber 3 adjacent a top 9 and rear 10 of said chamber 3. The holding chamber 3 is divided into upper and lower compartments 15, 16 connected by means of a conduit 17 located on a base 18 of the upper compartment 15. The lower compartment 16 includes a holding chamber outlet 20 which leads to the dispensing chamber 4, the outlet 20 being disposed towards a rear and top of the lower compartment 14. The dispensing chamber 4 includes a dispensing outlet spout 25 disposed on a base 26 of the chamber 4.

The device 1 further includes means for mounting thereof to a drum of a washing machine which in this case comprise a pair of suction pads 30 mounted on a rear face of the device 1, which in use engage an interior face 28 of a drum 29 of the washing machine In use, and referring to FIGS. 1 to 4, the device is mounted to an interior surface of a inner drum of a washing machine by attaching the suction pads 30 to the drum. Once attached, an effective amount of rinse conditioner is added to the reservoir chamber through the reservoir opening 5 and once added the opening 5 is closed by the closure 11. The machine is then started. During the first rinse cycle, centrifugal forces generated within the drum force the liquid composition within the holding chamber towards the rear and the top of the chamber. Consequently, by virtue of the disposition of the reservoir chamber outlet 6, the composition is forced during the first spin cycle through the reservoir chamber outlet 6 into the upper compartment 15 of the holding chamber 3 where it will be restrained towards a rear of the chamber while the centrifugal forces generated by the first spin cycle remain. Once the first spin cycle has finished, the centrifugal forces will stop, and the composition will pass under the force of gravity through the conduit 17 in the base of the upper compartment 15 into the lower compartment 16. The composition remains in the lower compartment 16 until the second spin cycle begins whereupon the centrifugal forces generated force the composition towards the top and rear of the lower compartment 16, through the holding chamber outlet 20 and into the dispensing chamber 4. It should be noted that none of the composition passes back into the upper compartment 15 during the second spin cycle due to the fact that the conduit 17 connecting the compartments 16, 15 is disposed towards the front of the respective compartments 16, 15. During the second spin cycle the composition that has entered the dispensing chamber 4 is restrained by centrifugal forces towards the rear of the chamber 4 until completion of the spin whereupon it falls under gravity towards the dispensing outlet spout 25 in the base 26 of the chamber 4 from which it is delivered into the drum of the machine.

Referring to FIGS. 5 and 6 there is illustrated a holding chamber according to an alternative embodiment of the invention, indicated generally by the reference numeral 30, in which parts similar to those identified with reference to the previous embodiment are assigned the same reference numerals. In this embodiment the holding chamber 30 comprises an upper region 31 which receives the filling chamber outlet, and a lower region 32 from which the composition is delivered to the dispensing chamber 4. As can be seen from FIG. 6, an inner wall 35 of the lower region is spaced inwardly of a base of the upper region, towards the drum of the machine, so that composition which falls from the upper region under the force of gravity in the period between the first and second spins, when subjected to centrifugal forces during the second spin, will be restrained by a ledge 36 and thus be prevented from passing back into the upper region 31.

The invention is not limited to the embodiments and process steps described herein which may be varied in both construction, detail and sequence without departing from the spirit of the invention.

What is claimed is:

1. A device for dosing a fabric treatment composition to a drum of a top loading automatic washing machine of the type comprising a washing stage and at least two spin cycles, the device comprising at least three interconnected chambers mounted to a drum of the washing machine, namely:

a reservoir chamber having filling opening means and an outlet;

a holding chamber communicating with the reservoir chamber outlet for receiving said composition from said reservoir chamber during a first of said spin cycles; and a dispensing chamber communicating with a holding chamber outlet for receiving said composition from said holding chamber during a second of said spin cycles, the dispensing chamber further including an outlet for dispensing said composition upon substantial completion of said second spin cycle, said holding chamber comprising an upper region which receives and holds treatment composition from the reservoir chamber during the first spin cycle, a lower region which delivers treatment composition to the dispensing chamber during the second spin cycle, and an intermediate region connecting the upper and lower regions such that between the first and second spin cycles the treatment composition is transferred under the force of gravity from the upper to the lower region, said upper and lower regions comprising distinct upper and lower compartments and wherein the intermediate region comprises a conduit connecting the compartments.

2. A device as claimed in claim 1 in which the conduit is arranged on a base of the upper compartment, wherein the base is preferably shaped to funnel treatment composite into the conduit.

3. A device as claimed in claim 1 in which the holding chamber has a rear wall facing a wall of the drum of the machine, and a front face, and wherein the conduit is spaced from the rear wall.

4. A device as claimed in claim 1 in which at least three chambers are connected in series.

5. A device as claimed in claim 1 including means for the mounting thereof to an interior of the drum of the machine.

6. A device as claimed in claim 5 including means to allow retro-fitting of the device to the drum of the machine.

7. A device as claimed in claim 1 in which the dispensing outlet is disposed towards a lower portion of the dispensing chamber.

8. A device as claimed in claim 1 in which the reservoir chamber includes closure means for the filling opening.

9. A laundry washing machine comprising the device as claimed in claim 1.

10. In combination, a device according to claim 1 and a fabric treatment composition, such as a liquid rinse conditioner.

11. Use of a device as claimed in claim 1 for delivering liquid rinse conditioner to an interior of a drum of a washing machine during a rinse cycle of an automatic washing machine.

12. A process for delivering fabric treatment composition to an interior of a drum of a washing machine during a rinse cycle of the machine by employing a device according to claim 1, the process comprising the steps of:

adding fabric treatment composition to the reservoir chamber prior to a start of wash cycle;

carrying out a wash cycle;

carrying out the first spin cycle whereupon the fabric treatment composition is transferred under centrifugal forces from the reservoir chamber to the holding chamber;

carrying out the second spin cycle whereupon the treatment composition is transferred under centrifugal forces from the holding chamber to the dispensing chamber;

delivering the treatment composition from the dispensing chamber to the interior of the drum under force of gravity prior to and/or during addition of final rinse solution;

carrying out a final rinse cycle by agitating the fabrics, rinse solution and treatment composition for an effective period of time; and carrying out a final spin.

13. A device for dosing fabric treatment composition to a drum of a top loading automatic washing machine of the type comprising a washing stage and at least two spin cycles, the device comprising at least three interconnected chambers mounted to a drum of the washing machine, namely:

a reservoir chamber having filling opening means and an outlet;

a holding chamber communicating with the reservoir chamber outlet for receiving said composition from said reservoir chamber during a first of said spin cycles; and a dispensing chamber communicating with a holding chamber outlet for receiving said composition from said holding chamber during a second of said spin cycles, the dispensing chamber further including an outlet for dispensing said composition upon substantial completion of said second spin cycle, at least three of said interconnected chambers being connected in series said, reservoir chamber having a rear portion adjacent the drum of the machine, an opposed front portion, and a top portion, wherein the reservoir chamber outlet means is disposed adjacent the rear and top portions of the chamber.

14. A device as claimed in claim 13 in which the rear and top portions are shaped to funnel treatment composition into the reservoir chamber outlet under the centrifugal forces generated during the first spin cycle.

15. A device for dosing fabric treatment composition to a drum of a top loading automatic washing machine of the type comprising a washing stage and at least two spin cycles, the device comprising at least three interconnected chambers mounted to a drum of the washing machine, namely:

a reservoir chamber having filling opening means and an outlet;

a holding chamber communicating with the reservoir chamber outlet for receiving said composition from said reservoir chamber during a first of said spin cycles; and a dispensing chamber communicating with a holding chamber outlet for receiving said composition from said holding chamber during a second of said spin cycles, the dispensing chamber further including an outlet for dispensing said composition upon substantial completion of said second spin cycle, said holding chamber comprising an upper region which receives and holds treatment composition from the reservoir chamber during the first spin cycle, a lower region which delivers treatment composition to the dispensing chamber during the second spin cycle, and an intermediate region connecting the upper and lower regions such that between the first and second spin cycles the treatment composition is transferred under the force of gravity from the upper to the lower region, the holding chamber outlet means being disposed adjacent an upper rear portion of the lower region.

* * * * *